United States Patent [19]

Patelli

[11] Patent Number: 5,063,727

[45] Date of Patent: Nov. 12, 1991

[54] PACKAGING MACHINE FOR MANUFACTURE, FILLING AND SEALING OF SACHETS

[75] Inventor: Ferruccio Patelli, Bologna, Italy

[73] Assignee: M.A.P.A. S.r.l., Quarto Inferiore, Italy

[21] Appl. No.: 540,849

[22] Filed: Jun. 20, 1990

[30] Foreign Application Priority Data

May 3, 1990 [IT] Italy ..... 3476 A/90

[51] Int. Cl.[5] ..... B65B 9/20; B65B 51/30; B65B 51/14; B65B 51/16

[52] U.S. Cl. ..... 53/552; 53/374.8

[58] Field of Search ..... 53/451, 550, 551, 552, 53/479, 374.8; 156/515, 583.1

[56] References Cited

U.S. PATENT DOCUMENTS

| | | | |
|---|---|---|---|
| 3,070,931 | 1/1963 | Zwight | 53/552 |
| 3,583,126 | 6/1971 | McCollough | 53/551 X |
| 4,199,919 | 4/1980 | Moscatelli | 53/552 |
| 4,265,074 | 5/1981 | Reuter et al. | 53/551 |
| 4,291,520 | 9/1981 | Prince et al. | 53/373 X |
| 4,341,057 | 7/1982 | Limousin | 53/373 X |
| 4,517,790 | 5/1985 | Kreager | 53/552 |
| 4,524,567 | 6/1985 | Patelli | 53/552 |
| 4,663,917 | 5/1987 | Taylor et al. | 53/552 |
| 4,750,313 | 6/1988 | Kammler et al. | 53/552 X |
| 4,751,808 | 6/1988 | Hadden | 53/551 X |
| 4,862,673 | 9/1989 | Francioni | 53/550 X |
| 4,947,618 | 8/1990 | Schneider et al. | 53/552 X |

*Primary Examiner*—Horace M. Culver
*Attorney, Agent, or Firm*—Herbert Dubno

[57] ABSTRACT

A packaging machine for manufacturing sachets including a first pair of jaws for the a transversally pressure and heat sealed tube from a strip of pressure and heat sealable material formed by tangentially counter-rotating gripper controlled by an actuator with a continuous movement of the cyclical type, in which the tangentially counter-rotating gripper is constructed in the form of opposite pressure and heat sealing jaws and at least one of these jaws is controllable with an adjustable and the actuator with a continuous movement are designed to adjust, in conjunction with the thrust action, the pressure and heat sealing time as a function of the thickness and constituent structure of the pressure and heat sealable material used.

5 Claims, 4 Drawing Sheets

PACKAGING MACHINE FOR MANUFACTURE, FILLING AND SEALING OF SACHETS

FIELD OF THE INVENTION

The present invention relates to an integral system for the pressure and heat sealing of pressure and heat sealable packaging material in machines for producing, filling and sealing sachets and a machine using this system.

BACKGROUND OF THE INVENTION

Machines for producing, filling and sealing sachets, which produce these sachets from a strip of material which is usually pressure and heat sealable and fill them with products of various kinds, for instance solids, liquids, powders or granules and other loose materials, are well known.

Machines of this type and for the above described usage to which the invention relates generally comprise a vertically extending operating structure and essentially comprise a frame or base and, supported on this base, a tube with a vertical spindle, a member in the form of a shaping collar disposed within this tube with a vertical spindle so as form an annular space thereby providing a kind of drawing member, means for supporting a spool of pressure and heat sealable material and for supplying the latter downwardly through this annular space between the shaping collar member and the tube with a vertical spindle and folding it into a tubular shape around and along the tube with the vertical spindle with its longitudinal edges overlapping, means for supplying the product to be packaged above this tube with the vertical spindle, drive means with an intermittent movement below this shaping collar member in contact with the tube with a vertical spindle designed to drive the strip intermittently downwards along the tube with a vertical spindle, the length of each intermittent movement being equivalent to the length of the sachet to be obtained, pressure and heat sealing means disposed along the tube with a vertical spindle at the level of the drive means with an intermittent movement and respectively below these latter means for pressure and heat sealing of the overlapping longitudinal edges of the strip and transversely to the tube of pressure and heat sealable material obtained in this way during the dwell period of each intermittent movement and means designed to actuate the pressure and heat sealing means alternately in conjunction with the dwell period of each intermittent movement.

In these known machines with an intermittent movement, the intermittently moving drive means are usually formed by two more or less vertically elongate closed-loop belts disposed diametrically with respect to the vertical tube. These belts are obviously synchronized for the intermittent downward drive movement of the strip folded into its tubular shape and a machine of this type with drive belts is known commercially as an intermittent "caterpillar" drive machine.

Like all machines operating with an intermittent movement, these machines with an intermittent movement for producing, filling and sealing sachets have unit output limits due not only to the dwell periods of the cyclical intermittent movements in which the operations leading to the formation of the desired product can be carried out, but also to the inertial forces of the moving components which make up the complex kinematic mechanism designed to achieve this intermittent movement. In the case of machines with an intermittent cycle of the type in question which comprise a sealing stage which, as is known, depends for its success not only on temperature and time, but also on the contact pressure of the sealing members with the pressure and heat sealable material, which is a non-negligible technical and commercial feature, these unit output limits are also due to the constructional complexity of the sealing members for the conduct of the pressure and heat sealing with variations in the operating speed of the machine.

In order to remedy these speed limits imposed by the mechanical structure of these machines for producing, filling and sealing sachets, the applicants have previously disclosed, in their Italian Patent Specification 1 145 089 analogous to the U.S. Pat. No. 4,524,567, a machine of this type operating with a continuous movement and structured so that the sealing contact time between the sealing members and the pressure and heat sealable material for the formation of the sachets varies to the required extent with variations in the unit output speed.

In order to achieve this, a machine of the type in question is characterized, in accordance with the above Italian Patent in the name of the applicants, in that the drive means and the pressure and heat sealing means for the pressure and heat sealing transverse to the tube of pressure and heat sealable material are associated with support means controlled by actuation means with a continuous movement below the tube with a vertical spindle, the drive means comprising two members having sectors with cylindrical surfaces counter-rotating tangentially with respect to a plane containing the axis of descent of this tube of pressure and heat sealable material and in which these drive means with a continuous movement are provided with a cyclical differentiating device for the transmission of this movement.

Machines of this type constructed in accordance with the above-mentioned Italian Patent 1 145 089 in the name of the applicants having drive means with a continuous movement, although achieving optimum results from the point of view of product quality and output speed per unit of time have in practice proved inadequate for achieving transverse pressure and heat seals when certain relatively thick pressure and heat sealing materials are used and in particular as a function of the features of their constituent structure.

Machines with an alternating movement of the type having a unit production speed of this kind and for the above-mentioned uses and having a vertically extending operating structure which take account, in addition to temperature and time, of the contact pressure between the sealing members and the pressure and heat sealable material are already known. For instance, the U.S. Pat. No. 4,040,237 of 18 June 1976 discloses a mechanism for forming pressure and heat seals or the like in adjacent layers of strip material as part of a method for forming packagings carried out by a machine comprising two jaws and means for slidably supporting and actuating the two jaws so as to move them between open and closed positions. One of the two jaws is fixed to a slide supported so as to slide with respect to a base along a given sliding axis and the other is supported slidably on a slide for the sliding movement along the same sliding axis. A crank mechanism simultaneously moves the slide and the other jaw in order to actuate the two jaws in opposite directions towards their open or closed positions depending on the direction of rotation of the crank. In the closing direction of the jaws the crank mechanism has a toggle action so as to provide a high closure force between the jaws causing the jaws to close gently with no recoil or violent impact.

These crank mechanisms with a toggle pressure action come within the scope of typically intermittent unit speed machines as a result of which they do not adequately satisfy the pressure requirement of faster machines with a vertical operating structure having drive means with a continuous movement, for instance of the type disclosed in the above-mentioned Italian Patent 1 145 089 in the name of the applicants.

OBJECTS OF THE INVENTION

The main object of the present invention is therefore to provide an integral system for the pressure and heat sealing of the pressure and heat sealable packaging material in machines of this type for the abovementioned uses and in particular machines with a vertical operating structure in which account is taken, in addition to temperature and time, of the contact pressure of the sealing members with the pressure and heat sealable material especially when use is made of certain relatively thick heat sealing materials and in particular as a function of the characteristics of their constituent structure.

A further object of the present invention is therefore to provide, for a machine of the type and for the uses mentioned above having a vertical operating structure with faster drive means with a continuous movement, a pressure system appropriate to these faster drive means with a continuous movement.

Still another object of the present invention is to provide a pressure system of this type designed to allow the adjustment of the pressure and time for the pressure and heat sealing as a function of the thickness and constituent structure of the materials mentioned above.

A further object of the present invention is to provide a pressure system of this type which also allows the pressure and heat sealed component to be cut in a timed relationship with the time needed for pressure and heat sealing.

Finally, another object of the present invention is to provide a pressure and cutting system of this type which is very simple in operation and of a relatively economic cost in relation to the practical results which can be achieved therewith.

SUMMARY OF THE INVENTION

These and other objects described in detail below are all achieved by the machines for producing, filling and sealing sachets using the integral system of the present invention for the pressure and heat sealing of the pressure and heat sealable packaging material, which system is characterized in that it comprises means formed as opposite pressure and heat sealing counter-rotating jaws controlled by actuation means with a continuous rotary movement of the cyclical type, control means designed to control at least one of the jaws in cyclical phase by a thrust movement, means for adjusting this thrust action and means for adjusting the pressure and heat sealing time as a function of the thickness and constituent structure of the pressure and heat sealable material used.

The machine for producing sachets using this system for the pressure and heat sealing of the pressure and heat sealable packaging material and producing these sachets from a strip of pressure and heat sealable material and filling them with solid, liquid, powder, granular or other loose products comprising a vertically extending operating structure essentially comprising a vertical frame or base and, supported on this base, a tube with a vertical spindle, a member in the form of a shaping collar disposed within this tube with a vertical spindle so as form an annular space thereby providing a kind of drawing member, means for supporting a spool of pressure and heat sealable material and for supplying the latter downwardly through this annular space between the shaping collar member and the tube with a vertical spindle and folding it into a tubular shape around and along the tube with the vertical spindle with its longitudinal edges overlapping, means for supplying the product to be packaged above this tube with the vertical spindle, drive means with an intermittent movement in contact with this tube with a vertical spindle designed to drive the tubular folded strip intermittently downwards along the tube with a vertical spindle, the length of each intermittent movement being equivalent to the length of the sachet to be obtained, pressure and heat sealing means disposed along the tube with a vertical spindle at the level of the drive means with an intermittent movement for the pressure and heat sealing of the longitudinal overlapping edges of the tubular folded strip and respectively below this tube with a vertical spindle for the pressure and heat sealing transverse to the tube of pressure and heat sealable material obtained in this way and means designed to actuate all these means in cyclical phase, the means for the pressure and heat sealing transverse to the tube of pressure and heat sealable material being of the type controlled by actuation means with a continuous rotary movement of the cyclical type, is characterized in that the means for the pressure and heat sealing transverse to the tube of pressure and heat sealable material controlled by the actuation means with a continuous rotary movement of the cyclical type are formed as opposite pressure and heat sealing counter-rotating jaws, at least one of which is controlled in cyclical phase by control means with a thrust action, in that means are provided for regulating these thrust action control means and in that the actuation means with a continuous movement are designed to adjust the pressure and heat sealing time as a function of the thickness and constituent structure of the pressure and heat sealable material used.

BRIEF DESCRIPTION OF THE DRAWING

Further characteristics and advantages of the machine of the present invention will be set out in the following detailed description of a preferred embodiment given solely by way of non-limiting example with reference to the accompanying drawings, in which.

SPECIFIC DESCRIPTION

Figure 1:
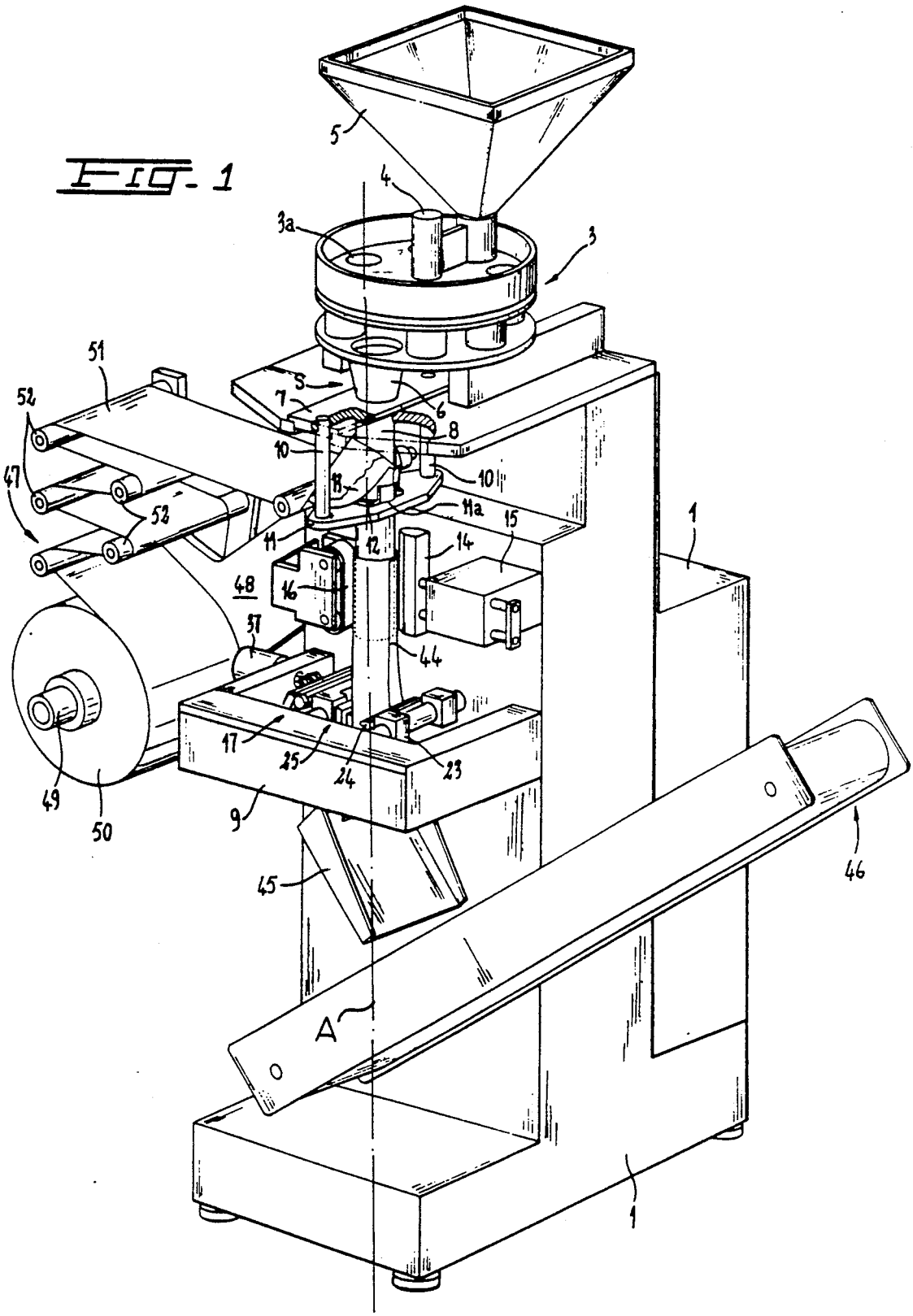
FIG. 1 is a front perspective view of this machine with some components removed or shown in section so that others can be seen.
Figure 2:
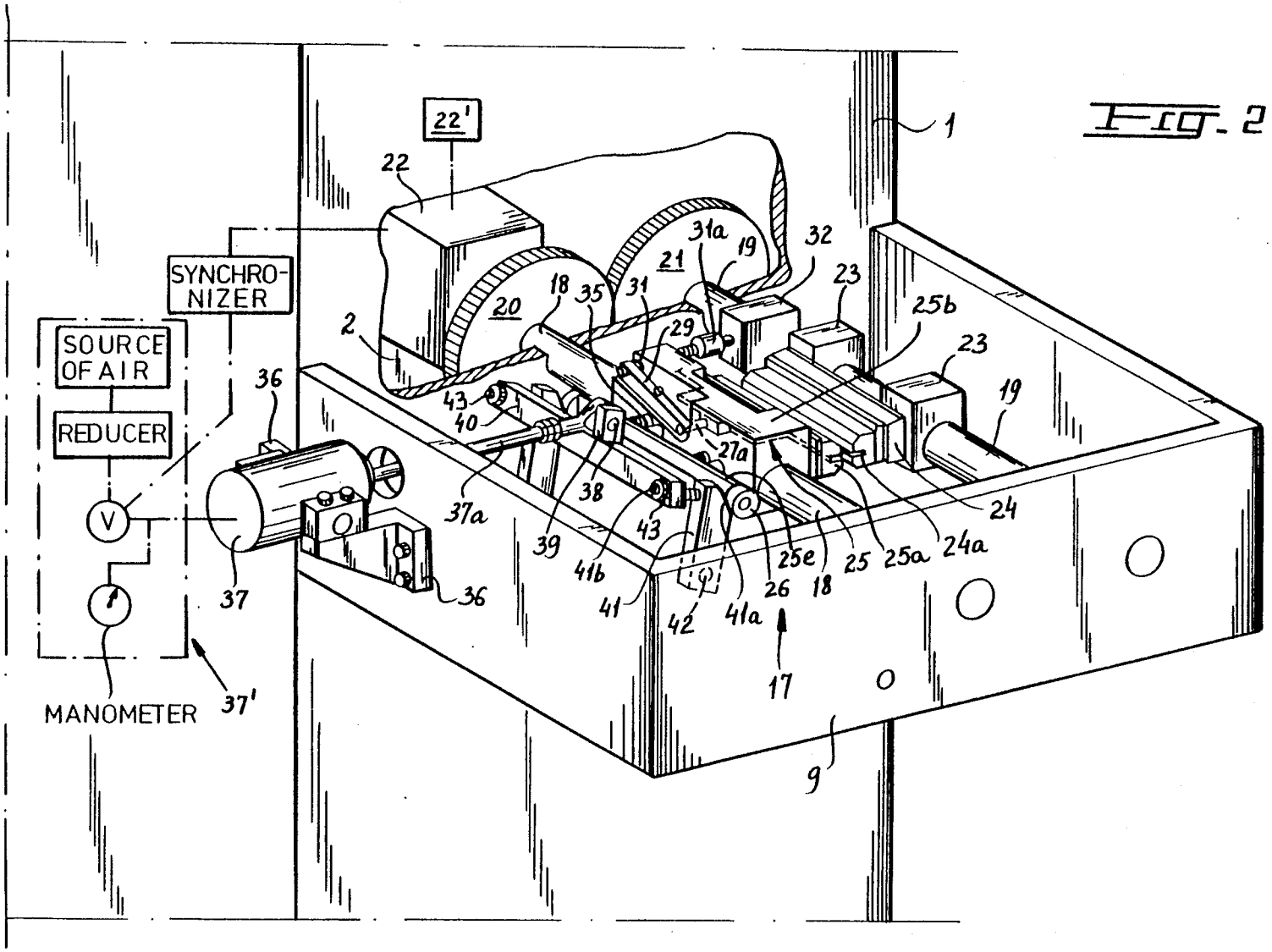
FIG. 2 is a top perspective view of the lower part of the machine of FIG. 1 affected by the teaching of the invention on an enlarged scale with some components removed and others shown in section so that further components can be seen.
Figure 3:
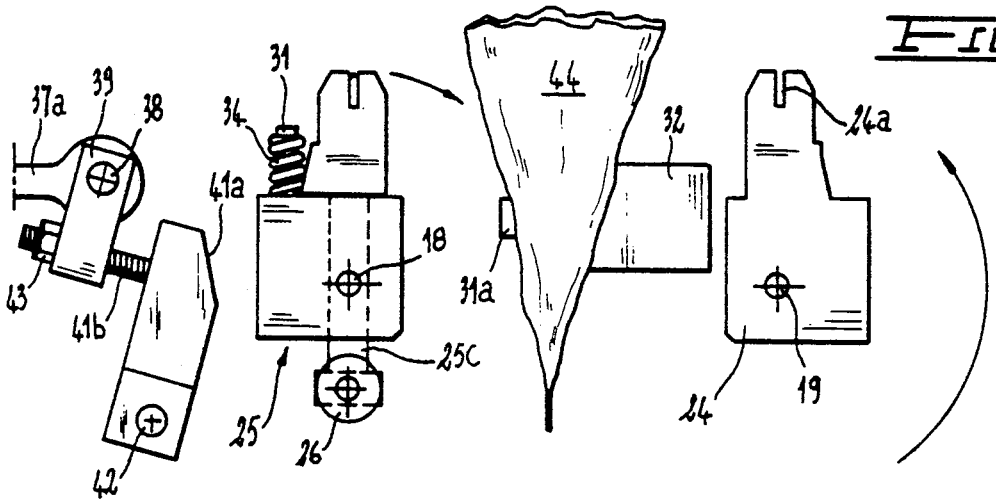
FIGS. 3, 4, 5, 6 and 7 are front views on an enlarged scale of the transverse pressure and heat sealing means of the present invention in three different operating positions, a diagrammatic plan view and an operating diagram.
Figure 4:
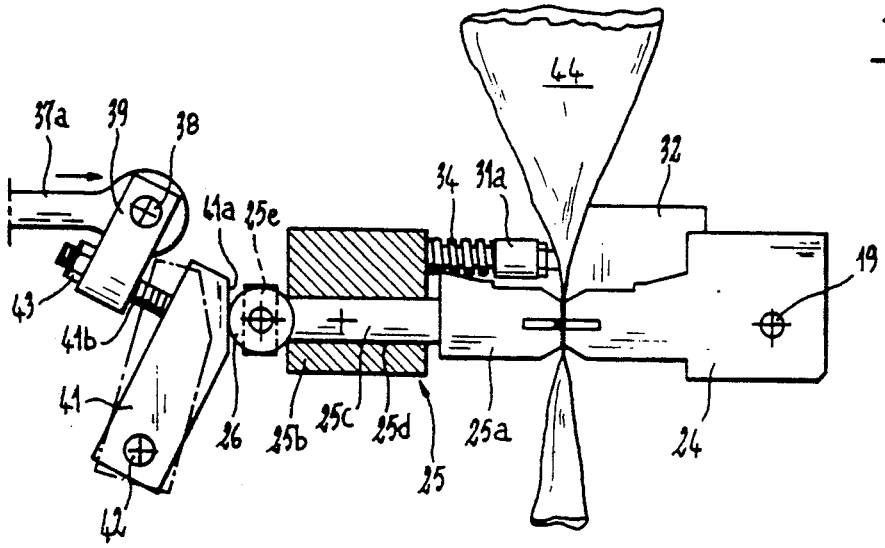
Figure 5:
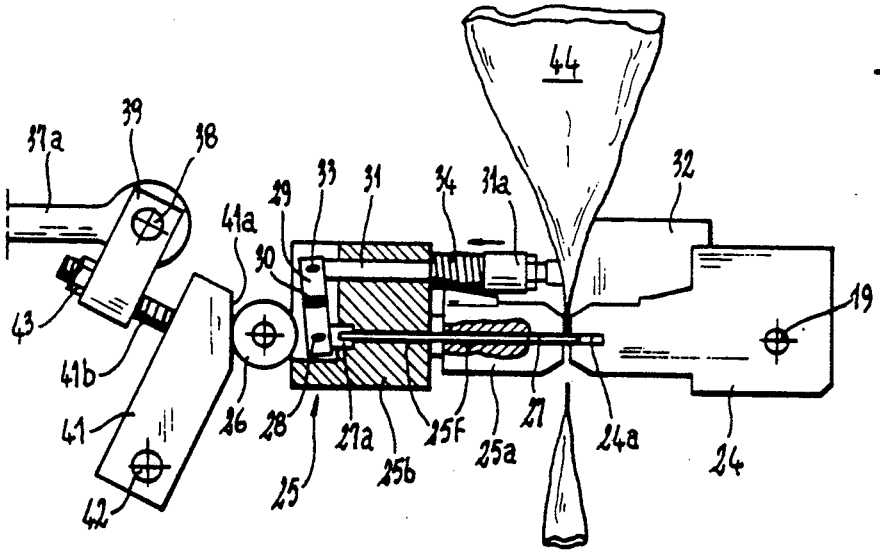
Figure 6:
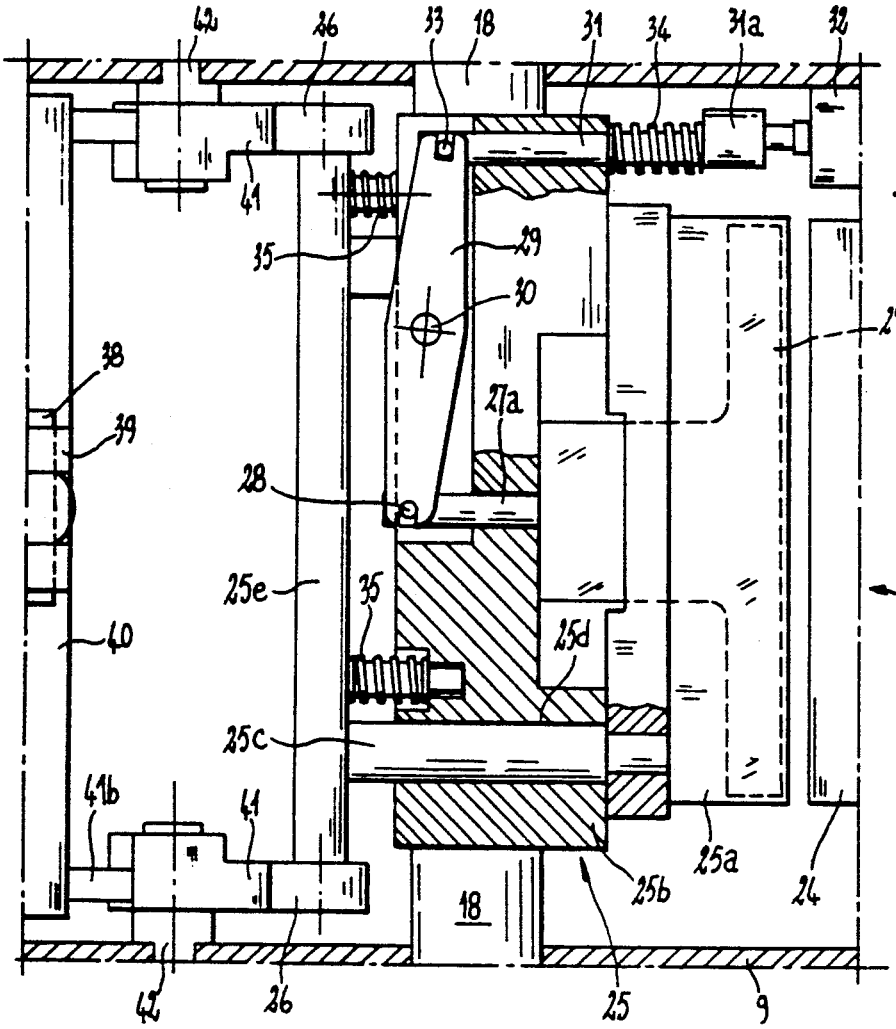

With reference to these Figures, and in particular FIGS. 1 and 2, it can be seen that the machine in question comprises a frame or base 1 extending vertically in the form of a rear cupboard with a central horizontal support bracket 2 (see FIG. 2) and closed by a detachable wall (not shown). This is a conventional machine structure, as disclosed for instance in the above-mentioned Italian Patent 1 145 089 in the name of the applicants and therefore comprises, supported in a known manner on this vertically extending base 1, a mechanism (not shown) for transmitting the intermittent movement to a supply device 3 supported coaxially by a vertical shaft 4 in the upper portion of this base 1 of the machine. A conventional hopper 5 for supplying the supply device 3 with the material to be packaged is disposed above this supply device 3. At a station S at which the cells or chambers 3*a* of the supply device 3 for the supply of the product to be packaged are caused to dwell by this supply device 3 for the supply of the product to be packaged there is provided a funnel member 6 supported by a fixed horizontal plate 7 projecting at the front from the upper portion of the base 1 of the machine. Below this funnel member 6, the fixed plate 7 supports a tubular member or tube with a vertical spindle 8 extending along an axis A downwards into the vicinity of a frame with a square contour 9 supported horizontally at the front in a snap-locking manner by the front wall of the base 1 of the machine. The fixed plate 7 supports, therebelow and in a diametrically opposite arrangement with respect to the tube with a vertical spindle 8 (see FIG. 1), two vertical rods 10 whose lower ends are rigid with a plate 11 having a hole 11*a* through which the tube with a vertical spindle 8 passes and around which there is disposed a tubular support member 12 fixed to the plate 11 and with which there is associated a shaping collar member 13. The combination of this shaping collar member 13 and the tubular support member 12 with the tube with a vertical spindle 8 provides an annular space forming a kind of drawing member as will be explained below. On one side of the tube with a vertical spindle 8, i.e. the right-hand side of FIG. 1, there is disposed a vertical sealing member 14 actuated with an alternating movement by a mechanism enclosed in a casing 15 fixed on the front surface of the base 1 of the machine and associated with a shaft (not shown) in phase synchronism with the other operating components of the machine. This vertical sealing member 14 is of the type conventionally comprising a device which can be manually actuated for the adjustment of its longitudinal pressure and heat sealing action on the opposite edges of the strip of pressure and heat sealable material folded in a tubular shape about the tube with a vertical spindle 8. At the location of this vertical sealing member 14 there is disposed, around the tube with a vertical spindle 8, one or more conventional "caterpillar" members 16 (only one of which is shown in FIG. 1) actuated intermittently in order to feed sections of tubular folded pressure and heat sealable strip to be supplied to the means for the transverse pressure and heat sealing in accordance with the teaching of the present invention shown overall by 17 (see FIGS. 1 and 2). These means 17 for the pressure and heat sealing transverse to the pressure and heat sealable material which has already been pressure and heat sealed longitudinally are disposed within the frame with a square contour 9 supported horizontally at the front in a snap-locking manner by the vertical base 1 of the machine substantially at the level of the rear horizontal support bracket 2 and comprise two horizontally supported transversally rotating spaced shafts 18 and 19 caused to counter-rotate by respective gears 20 and 21 in reciprocal engagement disposed at the rear above the rear horizontal (support bracket 2 (see FIG. 2). The shaft 18 is driven by a reduction gear variable-speed intermittent drive unit of known type supported in a fixed manner on the rear horizontal bracket 2, only the intermittence unit 22 of which is partially visible in FIG. 2. More specifically, the reduction gear used in the experimental machine prototype is of the type known commercially as Bonfiglioli MVF 86, the variable-speed unit is a Bonfiglioli LB1 speed variation unit and the intermittence unit is a Colombetti Filippetti CF3. On the controlled shaft 19 there are fixed in a longitudinally spaced manner two parallelepipedic blocks 23 supporting, horizontally and parallel to the controlled shaft 19, a monobloc sealing member 24 forming one of the elongate jaw members of the two counter-rotating pressure and heat sealing jaw members as will be described below, provided with a horizontal longitudinal slot 24*a* as well as known heating members (not shown). On the control shaft 18 there is fixed a second multibloc sealing member indicated overall by 25 forming the second elongate jaw member of the two counter-rotating pressure and heat sealing jaw members which is obviously also provided with heating members. This second multibloc sealing member 25 is formed by two longitudinally adjacent facing portions 25*a* and 25*b* connected together with a relative movement via a pair of rods 25*c* (see FIGS. 4 and 6 in particular) rigid with the part 25*a* and slidably engaged in respective holes 25*d* passing through the part 25*b* whose respective free ends external to the part 25*b* bear a crossbar 25*e* bearing a pair of spaced cam follower idler rollers 26 (see FIG. 4 and FIGS. 2 and 6). These two parts 25*a* and 25*b* forming this second sealing member 25 also have respective longitudinal slots 25*f* which are coplanar with one another and with the slot 24*a* of the monobloc sealing member 24 for the slidable housing, in the manner which will be described below, of a cutting blade 27 having a tailpiece 27*a* projecting externally from the part 25*b* of the multibloc member 25, i.e. on the left-hand side of FIG. 2. This tailpiece 27*a* of the cutting blade 27 is articulated at 28 (see FIGS. 2, 5 and 6) with the end of rocker member 29 which is in turn pivoted to oscillate at an intermediate point about a pin 30 disposed in an inclined manner in a vertical plane and fixed to a stepped portion of the part 25*b* of the second sealing member 25. A rod or bar 31 of a known device 32 with a fluid dynamic actuation slides through the part 25*b* of the second sealing member 25 and is articulated at 33 on the other end of the rocker member 29 so as alternately to actuate, in phase synchronism, the cutting blade 27 under and against the action of a return spring 34 keyed on the rod or bar 31 between a shoulder 31*a* thereof and the part 25*b* of the second sealing member 25. Return springs 35 are also disposed between the part 25*b* of the sealing member 25 and the crossbar 25*e* bearing the cam follower rollers 26. Supports 36 fixed externally to the frame 9 (see FIG. 2) support a fluid dynamic cylinder 37, for instance of the type known commercially as an SMC 80 pneumatic cylinder having a pressure discharged therefrom and regulated by control means 37' including a compressed air source connected with a reducer provided with a valve V and a manometric member displaying the pressure. A rod or bar 37*a* of the cylinder is articulated via a horizontal pin 38 on an upwardly projecting member 39 of a crossbar 40 supported adjustably at its opposite ends, in the manner which will be described below, by two members 41 hinged to oscillate on horizontal pins 42 of the frame 9 so as to extend upwards with an upper cam-shaped section 41*a* facing the cam follower rollers 26. Behind this upper cam-shaped portion 41*a* of each of the two members 41 a corresponding threaded member 41*b* is screw mounted, on which there engage corresponding through holes provided on the opposite ends of the crossbar 40 which can be adjusted into the desired position by locking nuts and bolts 43. A machine of this type, obviously below the counter-rotating jaw members 24 and 25 for pressure and heat sealing transverse to the heat sealable tube 44 at a level below that determined by the lower portion of the line described by the counter-rotating members 24 and 25, is provided with a chute member 45 for conveying the products obtained with the machine on a continuous conveyor belt shown overall by 46 for subsequent processing, for example collection or packaging in groups in cartons and the like, and on the left-hand side of FIG. 1, with a known system shown overall by 47 for the supply of the packaging material. This known system 47 for the supply of the packaging material is supported on a support member 48 (see FIG. 1) fixed to the base 1 of the machine and substantially comprises a spool-holder shaft 49 bearing a spool or roll 50 of the strip packaging material 51 and rollers 52 for guiding and conveying the strip 51 to the annular drawing member formed by the combination of the tube with a vertical spindle 8 and the shaping collar member 13.

Figure 7:
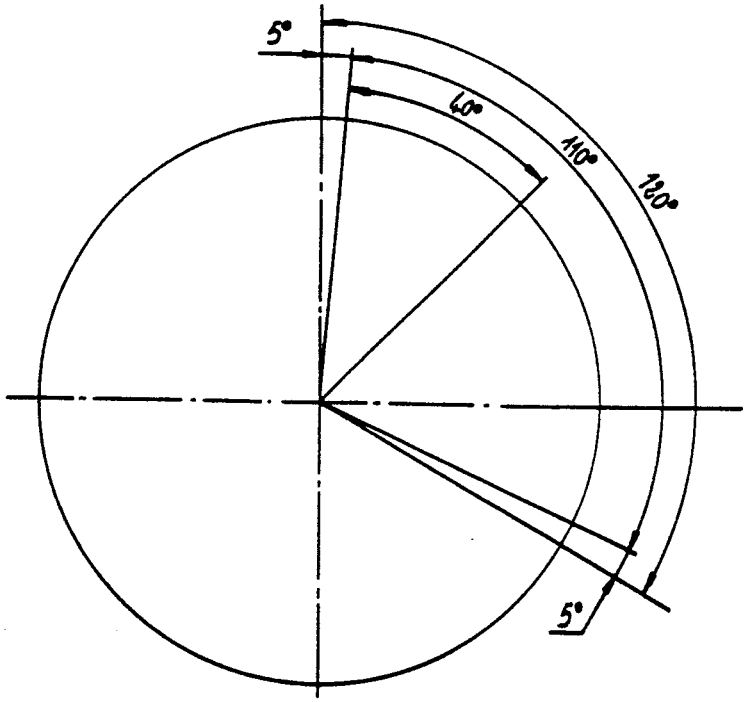

A machine as described with continuous actuation of the control members for the means which carry out the pressure and heat sealing operation transverse to the tube of pressure and heat sealable material operates substantially as follows:

The strip of packaging material 51 from the spool 50 is conveyed via the guide and conveyor rollers 52 so that it passes above the shaping collar member 13 and thus through the annular space formed between this shaping collar member 13 and the tube with a vertical spindle 8 so as to be folded into a tubular shape about and along this tube with a vertical spindle 8 with its longitudinal edges overlapping (see FIG. 1) and is entrained there intermittently by the "caterpillar" means 16 so as to bring it between the counter-rotating jaw members 24 and 25 actuated with a continuous counter-rotating movement by the reduction gear variable-speed intermittence drive unit 22 for pressure and heat sealing transverse to the pressure and heat sealable tube and for cutting of the pressure and heat sealed portion at the dwell time predetermined in combination with the intermittence unit in the manner which will be described below. In the case of the intermittence unit used in the experimental machine with a rotary cycle of 240° and a dwell period of 120° (see FIG. 7), i.e. at a ratio of 2.0 to 1 and leaving 5° upstream and 5° downstream of the dwell period for deceleration into the dwell period and acceleration of the continuous movement, it has been possible to obtain perfect seals by pressure and heat sealing of any type of pressure and heat sealable material nowadays commercially available for these packaging machines with a vertical structure operating within 110°. In this way it has been possible to observe that for certain materials now available it is possible to achieve an excellent pressure and heat seal transverse to the tube of pressure and heat sealable material in a time much below that of the 110° dwell period. It has therefore been observed, for instance, that by appropriately synchronizing the various operating components of the machine in particular, synchronizing a thrust action and a work at the intermittence unit 22 defining dwell period. and by varying the pressure so as also to vary the time for the pressure and heat sealing (see FIG. 7) other degrees become available and therefore time for other operations such as for cooling the pressure and heat sealed part, for packaging of the product and for varying the length of the packaging sachets over a wide range which is a very important characteristic.

The description of the machine in question made with reference to the accompanying drawings is obviously given purely by way of example and it is therefore evident that any modifications and variants suggested by practice and from its embodiment and use can be made thereto provided that they come within the scope of the following claims.

I claim:

1. A packaging machine for producing sachets comprising:

a frame having a base;

supporting means for supporting a spool of a pressure and heat-sealable packaging material mounted on said frame;

transporting means operatively connected with said supporting means for advancing said packaging material intermittently toward said base at a predetermined length of each of successive intermittent movements along a path;

metering means for dosing a material to be packaged along said path;

shaping means on said frame downstream of said metering means for folding said packaging material in a tubular form, said shaping means being provided with a tube extending along a tube axis;

first pressure and heat sealing means on said frame along said path for axially sealing two longitudinal superimposed edges of said packaging material pressed against said tube;

second pressure and heat sealing means downstream of said first sealing means and below said tube on said frame for sealing said packaging material transverse to said tube axis at said predetermined length, said second sealing means including a first pressure and heat sealing jaw and a second pressure and heat sealing jaw movable between a closed and opened position thereof, said first sealing jaw including first and second portions movable relative to one another;

actuation means for providing a continuous rotary machine cycle including a reduction gear variable-speed intermittence drive unit operatively connected with said jaws and defining a dwell period within said machine cycle, said jaws being counterotatable about respective axes of rotation extending perpendicular to said tube axis and being adjacent one another in said closed position with said second portion bearing against said packaging material;

adjusting means operatively connected with said drive unit for controlling a duration of said dwell period, so that a heat sealing time is adjusted as a function of a thickness of said packaging material;

control means for adjusting a thrust action on at least said first jaw, said control means including a fluid dynamic cylinder operatively connected with said second portion of said first jaw; and regulating means for controlling a force applied from said fluid cylinder, so that said thrust action is regulated as a function of the thickness of said packaging material.

2. The packaging machine defined in claim 1, further including:

a pair of rods extending horizontally perpendicular to said axes of rotation and slidably mounted in said first portion of the first jaw, said rods being rigidly connected to said second portion and formed with respective ends protruding beyond said first portion of said first jaw, said portions being adjacent in an opened position of said jaws;

a cross bar connected with said ends of said rods and extending parallel to the axes of rotation, said cross bar being provided with a pair of spaced apart cam-follower rollers, said control means including:

a pair of cam-shaped members rotatably mounted on said frame and operatively connected with said fluid dynamic cylinder, said cam-shaped members acting upon said cam-follower rollers for actuating said pair of rods, a compressed air source, a pressure reducer device connected with said air source and provided with a valve, manometer means for displaying the pressure discharged from said reducer device connected with said fluid cylinder and with said regulating means; and means for synchronizing said actuation means and said control means, so that a rotation time degree/dwell time degrees ratio is variable.

3. The packaging machine defined in claim 1 wherein said regulating means includes a plurality of return springs mounted between said cross bar and said first portion of said first jaw, so that said pair of rods are actuated by said fluid cylinder against an action of said springs.

4. The packaging machine defined in claim 2 wherein said timing of said cycle and said dwell period in degrees are in a ratio is at least of 2.0 to 1.0.

5. A packaging machine for producing sachets comprising:

a frame having a base;

supporting means on said frame for supporting a spool of a pressure and heat-sealable packaging material;

transporting means operatively connected with said supporting means for advancing said packaging material intermittently toward said base at a predetermined length of each of successive intermittent movements along a path;

metering means for dosing a material to be packaged along said path;

shaping means on said frame downstream of said metering means for folding said packaging material in a tubular form, said shaping means being provided with a tube having a tube axis;

first pressure and heat sealing means on said frame along said path for axially sealing two longitudinal superimposed edges of said packaging material pressed against said tube;

second sealing means downstream of said first sealing means on said frame for sealing said packaging material transverse to said tube axis and for cutting off said material at said predetermined length, said second sealing means comprising:

a first pressure and heat sealing jaw and a second pressure and heat sealing jaw movable between a closed and opened position, said first and second jaws being mounted on respective shafts counterotatable about respective parallel axes extending perpendicular to said tube axis, said first jaw being formed with a first and second longitudinal portion adjacent one another in said opened position, said second portion of said first jaw pressing said material to be sealed against said second jaw in the closed position, a pair of rods mounted on said first jaw and extending horizontally perpendicular to said axes of rotation, said rods being rigidly connected to said second portion of the first jaw and being slidably mounted on said first portion, the rods being formed with respective ends protruding beyond said first portion of said first jaw, a cross-bar connected with said ends of said rods and extending parallel to the axes of said jaws, said cross bar being provided with cam means for actuating said pair of rods in said closed position of said jaws, and control means for adjusting a pressure between said jaws and a time of heat sealing in said closed position corresponding to a thickness of said packaging material upon extending said rods and said second portion, said control means including a fluid dynamic cylinder operatively connected with said second portion of the first jaw.

* * * * *